US006798436B2

(12) United States Patent
Campanini

(10) Patent No.: US 6,798,436 B2
(45) Date of Patent: Sep. 28, 2004

(54) THERMAL PRINTER CLOSING APPARATUS

(75) Inventor: Alberto Campanini, Fidenza (IT)

(73) Assignee: Custom Engineering SpA, Fontevivo (IT)

( * ) Notice: Subject to any disclaimer, the term of this patent is extended or adjusted under 35 U.S.C. 154(b) by 0 days.

(21) Appl. No.: 10/147,174

(22) Filed: May 8, 2002

(65) Prior Publication Data

US 2002/0175987 A1 Nov. 28, 2002

(51) Int. Cl.[7] ..... B41J 11/00
(52) U.S. Cl. ..... 347/222
(58) Field of Search ..... 347/197, 220, 347/222

(56) References Cited

U.S. PATENT DOCUMENTS 5,579,043 A * 11/1996 Patry ..... 347/222
6,118,469 A * 9/2000 Hosomi ..... 347/222
6,249,302 B1 * 6/2001 Sekiya ..... 347/220
6,567,113 B2 * 5/2003 Louis ..... 347/222

* cited by examiner

*Primary Examiner*—Huan Tran
(74) *Attorney, Agent, or Firm*—Lackenbach Siegel

(57) ABSTRACT

A closing apparatus for a thermal printer having a fixed chassis portion and a closable cover supporting on the inside thereof a paper drive roll fixed inside of the cover for positioning itself, when the printer is closed, in a seat associated with the chassis portion and having a bottom with a level wall for locking the paper drive roll and the seat together for locking the chassis and cover together in their closed condition for preventing the paper drive roll from getting out in case of accidental pushes and consequently prevents the cover from opening, and the paper drive roll and a thermal printing head cooperate to hold the paper between the paper drive roll and the thermal printing head while the cover is closed.

19 Claims, 5 Drawing Sheets

THERMAL PRINTER CLOSING APPARATUS

BACKGROUND OF THE INVENTION

The invention is concerned with a closing apparatus for a thermal printer. More particularly, this invention is concerned with the prevention of damage to the thermal printer due to an accidental opening of a cover, a falling of the printer or movements due to random vibrations.

Thermal printers generally include a fixed chassis portion and a cover associated with the chassis so that the cover and chassis together can enclose the printer. The fixed chassis portion is provided with all the printing devices, and fixed in its inside is a paper drive roll. A cover is provided to cover the various parts and with the chassis together provide for a complete closure.

In the printing art, these are known as apparatuses in connection with the closing method of the cover but up to the present there is no known solution to the problem of avoiding damage when the cover is opened and damage is caused.

BRIEF SUMMARY OF THE INVENTION

The closing apparatus according to the invention permits a paper drive roll to be fixed inside the cover to position itself, when the printer is closed, the roll moves in a suitable roll housing seat that locks the paper drive roll so as to prevent the paper drive roll from getting out of the printer apparatus in case of accidental pushes.

The seat has a bottom wall which is positioned in the same direction of the closing apparatus both when the printer cover of the printer is opened and access to the printer is provided or when the printer cover is closed and when the printer cover is opened and is moved during operation in the roll rotation direction. This permits the cover to maintain the roll in a fixed position on the seat bottom due to the force exerted by the roll, during its rotation in a clockwise direction, which causes the creation of a downwards push which helps to block the paper drive roll in the roll housing seat. As the cover is closed or moved from its open position to its closed condition, the roll is moved from one end of the roll housing seat to the other end of the seat, so that when the cover is open, the roll may be rotated, and when the cover is closed the roll is locked in the seat.

When the cover is finally closed and in its closed condition, the printer is in standby condition and blockage of the printer is created, produced by the shape of the roll housing seat, that absolutely prevents the roll from exiting or going out from the seat and consequently, the roll housing seat and paper drive roll cooperate together to lock the printer cover to the chassis and prevent the printer cover from opening and exposing the printer.

The direction of movement of the paper drive roll in response to the direction of the moving force of the paper drive roll, which is parallel with the seat bottom, helps to generate a push that keeps the paper drive roll on the bottom and blocking it.

When the printing phase begins, the paper drive roll brings itself or moves itself into the printing position. In the printing position, a possible outside force (for example a printer falling, vibrations, pushes or other cause) can actuate the paper drive roll and, according to the invention, the paper drive roll and the bottom wall of the seat together oppose such outside force.

In the direction of opening or closing of the printer cover, the same seat wall for the paper roll. The moving force of the paper drive roll is parallel to the seat bottom wall, and the moving force of the paper drive roll generates a push that keeps the roll on the bottom wall of the seat and blocks the movement of the paper drive roll to prevent the cover from opening.

The last force to be generated by the rotation of the paper drive roll on itself keeps the cover locked.

Thermal rings are provided on a thermal print head. The paper on which printing is to take place is kept pressed between the thermal print head and the paper drive roll by the push actuated by the thermal rings of the thermal head on the paper.

The closing apparatus, is suitable for any kind of thermal printer with a fixed chassis portion.

DETAILED DESCRIPTION OF THE INVENTION

Reference will now be made more particularly to the accompanying drawings which show the presently preferred mode for carrying out the invention.

The invention is a closure apparatus for a thermal printer to avoid damage to the printer due to an outside cause which may impart unwanted movement to the thermal printer.

Figure 8:
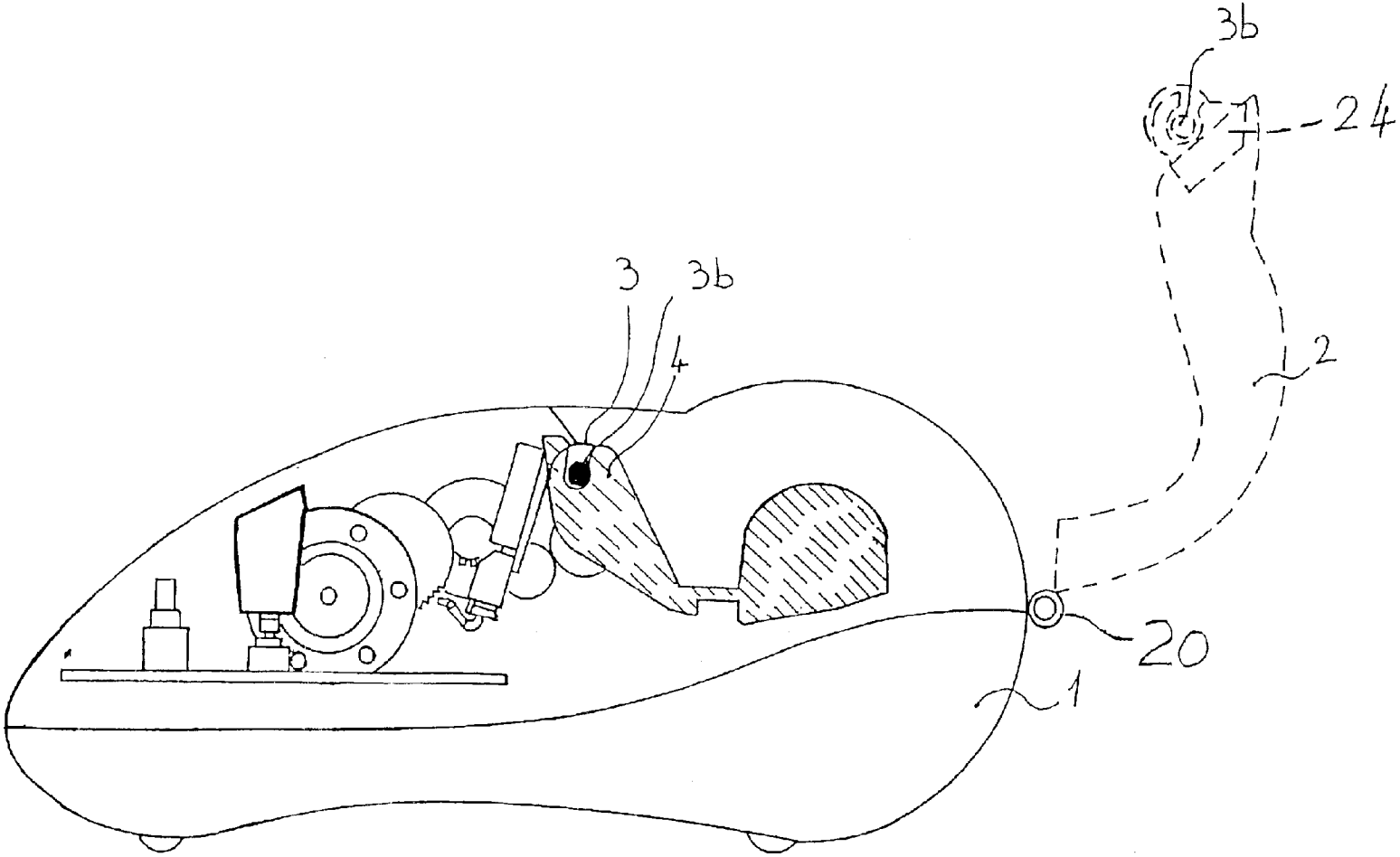
FIG. 8 is a view of a conventional thermal printer shown in an enclosure with cover 2 shown in full outline in its closed condition on chassis 1 and with the cover 2 open and shown in dashed outline.

The thermal printer includes a fixed chassis portion 1 and a cover 2 operatively associated with and coupled to chassis 1 for closure of the internal printing apparatus, as shown in the closed condition in full outline in FIG. 8 and with the cover 1 in its open condition shown in dashed outline. Cover 2 is hinged at one end by means of a hinged connection 20 to fixed chassis portion 1 which provides support for the printing apparatus as shown schematically.

Cover 2 includes a support mechanism 24 for supporting in a backlash way, a paper drive roll 3 for movement of a roll of paper 5 supported on a paper core member 22. Paper drive roll 3 comprises an outer rubber surface 3*a* and an inner steel shaft having a pair of opposite alternating outwardly from opposite ends 3*b*. Outside rubber 3*a* is molded onto the shaft 3*b*, and shaft has its opposite ends 3*b* which protrude from the outside rubber surface on both sides of the rubber surface.

Chassis 1 includes seat mechanism 4 associated with or forming part thereof, and cover 3 includes a support mechanism 24 coupled to or associated with cover 2 for carrying and supporting paper drive roll 3. Seat mechanism 4 and paper drive roll 3 cooperate together to form a locking mechanism to lock chassis 1 and cover 2 in their closed conditions.

Figure 1:
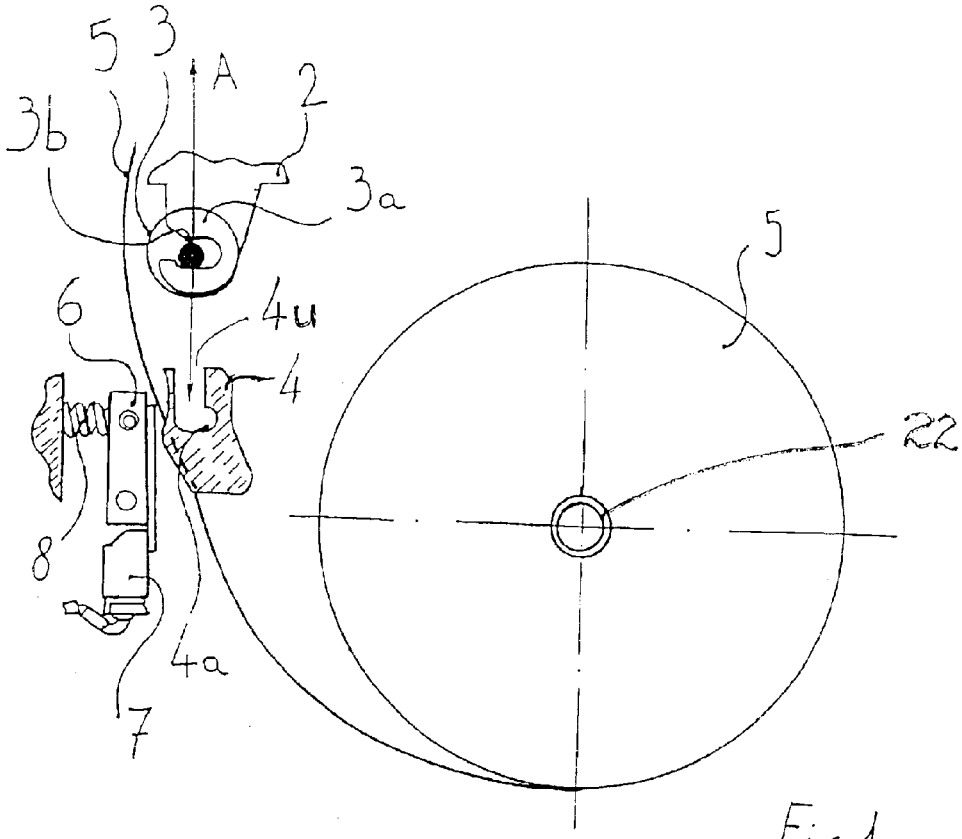
FIG. 1 is a schematic showing of a thermal printer and a closing apparatus therefor, and shows a cover in an opening phase or position.
Figure 6A:
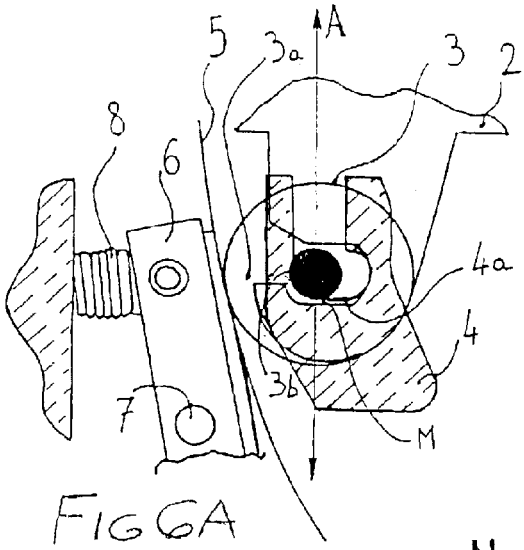
FIGS. 6*a* and 6*b* show the steel shaft 3*b* on which the paper drive roll is carried and placed proximate to the housing seat 4 at the bottom shown at the left of level of horizontal wall 4*a* thereof and the cover 2 closed during the printing phase, when shaft 3*b* moves from position M at the left in FIG. 6*a* at the left side of the drawing to the position E at the right side in FIG. 6*b* to show a safety closing.
Figure 6B:
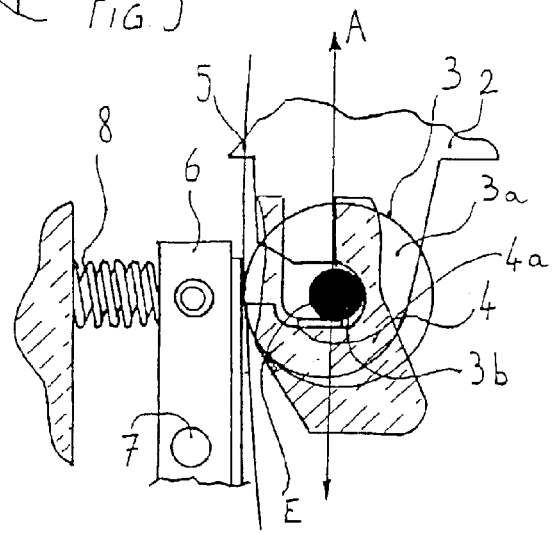
Figure 7:
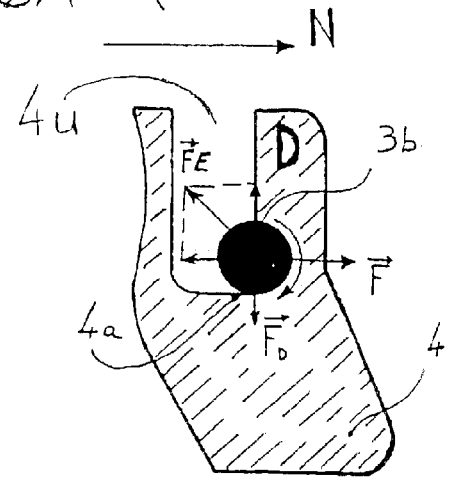
FIG. 7 is a schematic view of the different forces which act in the novel safety closing apparatus, and in particular show the steel shaft 3*b*which carries the paper drive roll 3 and extends through the drive roll 3 and extends outwardly from the paper drive roll 3 in the position M.
Figure 9:
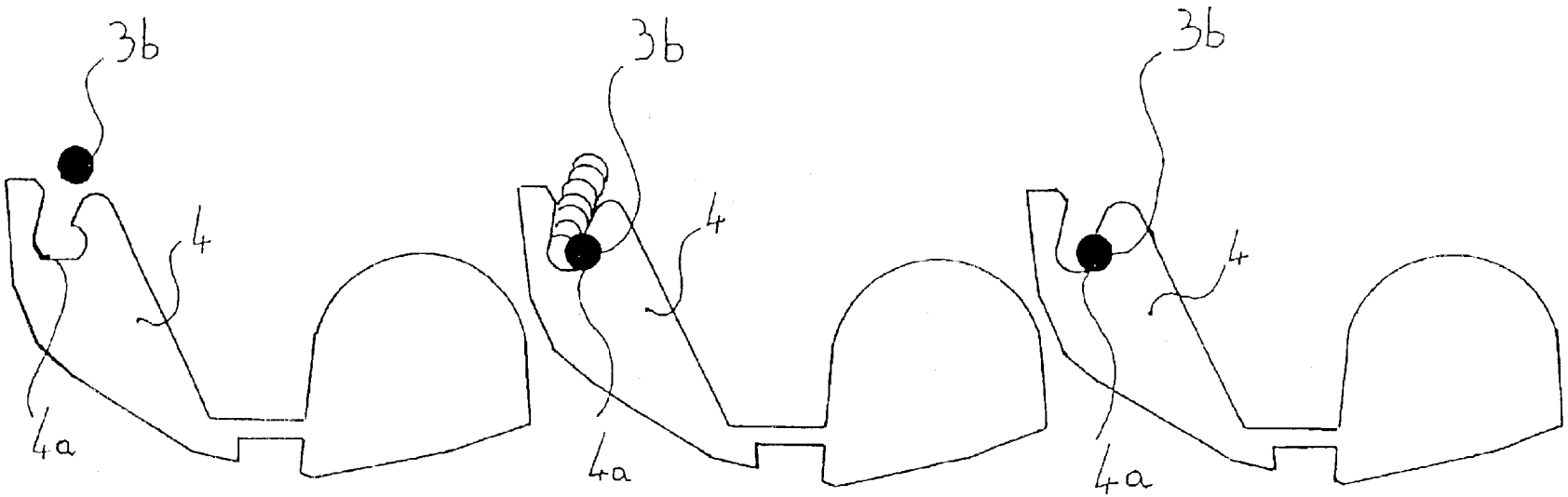
FIG. 9 shows the steel shaft 3*b* in three different positions as it moves during cover closing with respect to seat 4 and downwardly to the level wall 4*a* which forms the bottom or base of the housing seat for controlling the cover closing and prevent accidental pushes and vibrations, as well as an accidental opening of the cover which can damage the printer.

Chassis 1 is provided with housing seat 4 which has a bottom level wall 4*a* to receive the opposite ends 3*b* of the shaft, associated with cover 1, when shaft ends 3*b* move into housing seat 4 through opening 26 from its open cover position in FIG. 1 (and FIG. 9 dashed outline, to a beginning of closed cover position when the ends 3*b* of the shaft starts to enter a U-shaped opening 4U to move towards a bottom level wall 4*a*. As best seen in FIG. 7, the seat 4, including the U-shaped opening 4U with one end 3*b*of the steel shaft towards the right side of seat 4 resting on level wall 4*a*. The end 3*b* enters into the U-shaped opening 4U when cover 2 is substantially closed and moves downwardly towards the left side and is seated onto level wall 4*a* of seat 4 in a fully closed condition and moves from the left side towards the right side to a fully closed and locked condition. Level wall 4*a* is parallel to the arrow N, and end 3*b* moves from position M in FIG. 6*a* to position E in FIG. 6*b*.

Figure 4:
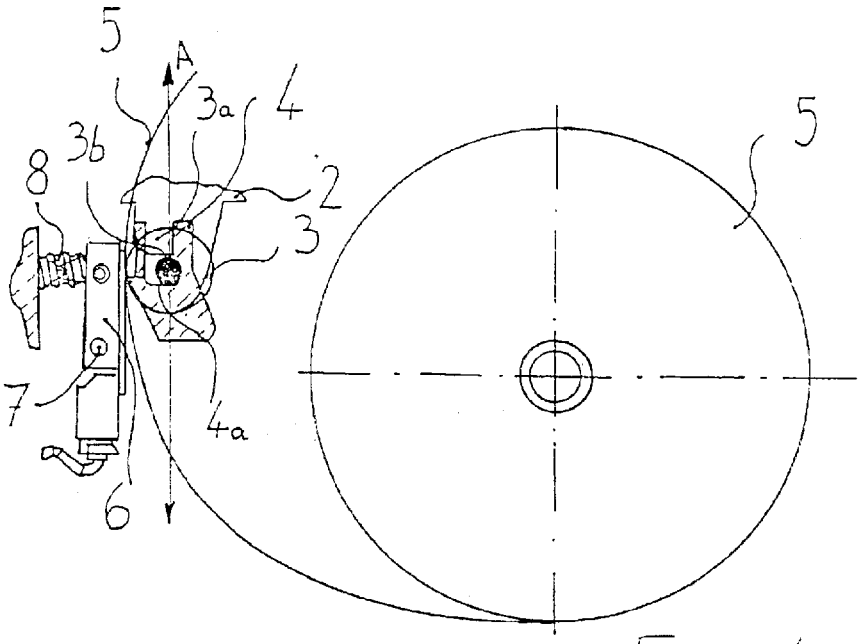
FIG. 4 is a schematic view or showing of the closed position of the cover on the thermal printer with the paper drive roll penetrating into the housing seat 4 and with the paper drive roll locked to the seat and the cover closed and the beginning of the printing phase of the thermal printing apparatus for the commencement of the printing phase and showing when the shaft of the printing roll moves from the position M in FIG. 6*a* to the position E in FIG. 6*b* with safety closing.
Figure 5:
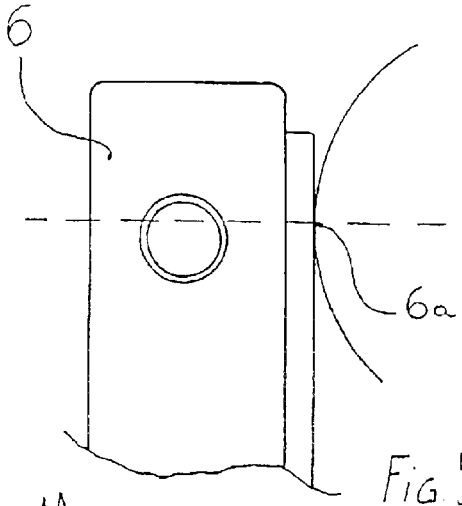
FIG. 5 is a partial schematic showing of the thermal head and the printing line shown in dashed horizontal line designated 6*a*, and with the printer and the cover in their closed condition.

As shown in FIG. 5, printing head 6 with a printing line 6*a* forms part of the thermal printing apparatus and paper roll 5, carried on core member 22 which is to be printed does not adhere to the printing line 6*a*. Paper 5 as shown in FIGS. 1 to 4, is shown as a complete paper roll, rolled upon itself carried by the core member 22 or shaft which forms a central axle so as to be easily unrolled into sheet form for printing.

Figure 2:
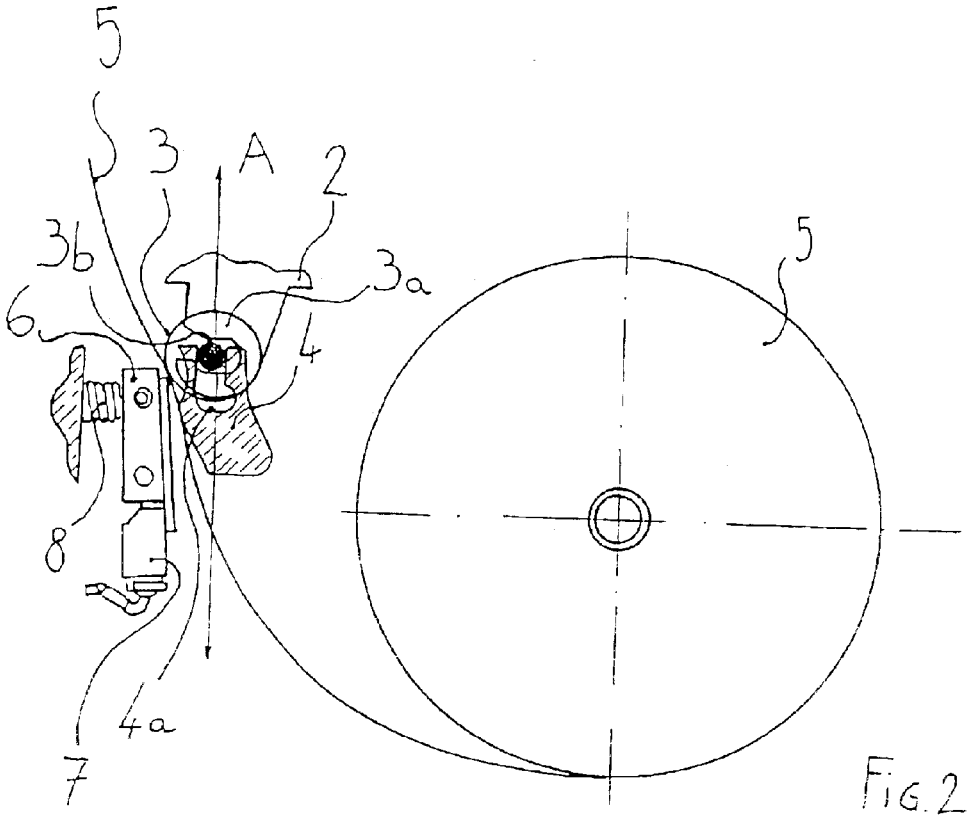
FIG. 2 is a schematic view or showing of the thermal printer showing the beginning of the closing phase with the printer head on its fulcrum and with the cover open and at the beginning of the closing phase.
Figure 3:
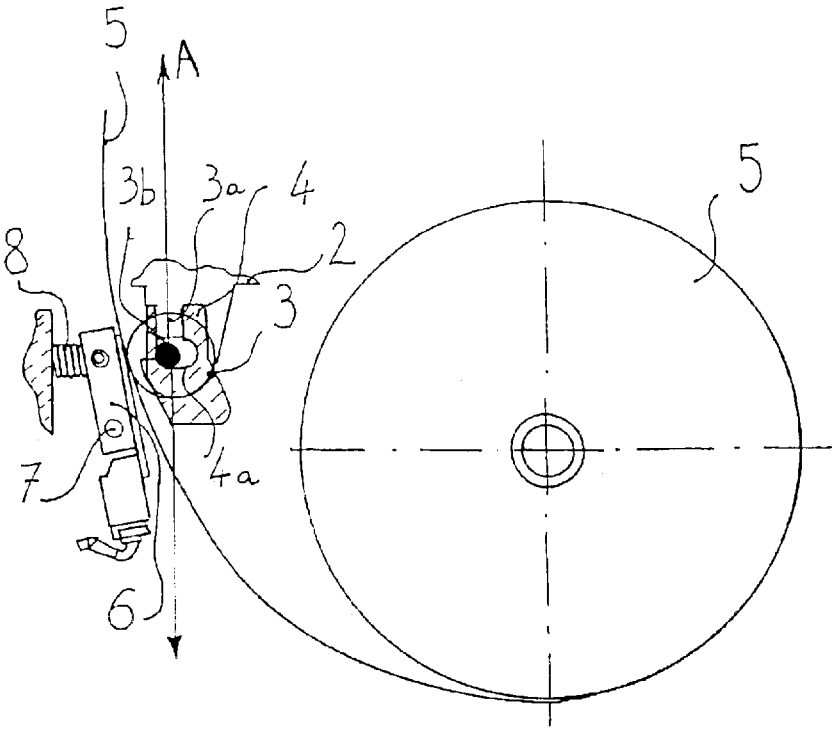
FIG. 3 is a schematic view or showing of the printer in its closed phase with the cover in its completely closed condition on the printer chassis or closed phase and showing the paper drive roll into the seat and moving or going with the thermal rotating head on its fulcrum.

As noted heretofore, the closing phase begins in FIG. 2 and then continues in FIG. 3. In FIG. 2, as noted, the ends 3*b* of the steel shaft start to enter the housing seat through 4U in FIG. 2, and then on the left side at the bottom 4*a* in FIG. 3 and then to the right side in FIG. 4.

Thermal head 6 is provided for printing and is provided with a printing line 6*a*. Thermal head 6 is carried or supported for rotation on fulcrum 7. Springs 8 are provided to move the thermal head 6 about fulcrum 7 from the position in FIG. 1 towards paper drive roll 3 to the position shown in FIG. 2 with paper 5, held between thermal head 6 and seat 4.

DESCRIPTION OF OPERATION

During the opening of the cover 2 (FIG. 1) the paper drive roll ends 3*b* is not in, but is outside of the housing seat 4 and is not in contact with bottom with level wall 4*a*. The paper 5 to be printed does not adhere to the printing line 6*a* of the thermal head 6. At the beginning the closing phase (FIG. 2 and FIG. 3), cover 2 and the end 3*b* of the steel shaft of the paper drive roll 3 enters through opening 4U and goes into the seat 4 and also causing the thermal head 6 to rotate on its fulcrum 7. With the cover definitively closed (FIG. 4) and with the thermal printer 1 in stand-by, ends 3*b* of paper drive roll 3 penetrates into the housing seat 4 and reaches the bottom on level wall 4*a*, thermal head 6 rotates from the lowering of the roll 3 on its fulcrum 7 and is pushed by the springs 8, to press the paper 5 between the paper drive roll 3 and the thermal head 6 as seen in FIG. 6*a* and then the ends 3*b* move from the left side to the right side of seat 4 as thermal head 6 moves about fulcrum 7 and rotates in a clockwise direction towards the right as shown in FIG. 6*b*.

Beginning with the printing phase (FIG. 4) the paper drive roll 3 begins to rotate keeping itself in the printing position E, (FIG. 6*b*) with the seat 4 and placed into operation by the rotation of the paper drive roll 3. In this printing position E a possible outside force FE (see FIG. 7) to be made on the paper drive roll 3 by an eventual falling or by possible vibrations or pushes is opposed. In the direction A of opening/closing of the cover 2, to the wall D (see FIG. 7) the seat 4 and the cooperation of and the paper drive roll 3 in the direction N parallel to the bottom 4*a* of the seat 4, in response to the force F (FIG. 7), the moving force of the paper drive roll 3 parallel to the bottom 4*a* of the roll housing 4. With the cover 2 locked to chassis 1 and the thermal head 6 and paper drive roll 3, the paper 5 is held between them for printing.

The moving force F of the paper drive roll is generated by the rotation of the paper drive roll 3 on itself. The paper 5 is kept compressed between the thermal head 6 and the paper drive roll 3, when this last one is in the printing position E, by the push actuated by the springs 8 on the same thermal head 6.

The various steps of the closing apparatus and working phases are illustrated in FIGS. 1 to 4, and show the various phases of opening and closing of the cover and the printing phase.

FIGS. 5 to 7 illustrate the housing seat 4 with its bottom 4*a*. FIG. 1 shows the cover 2 in its opening phase.

FIG. 2 shows the cover 2 at the beginning of the closing phase. FIG. 3 shows the cover definitively, closed.

FIG. 4 shows the closed cover with the beginning of the printing phase.

FIG. 6 shows the steel shaft 3*b* placed at the bottom 4*a* of the housing seat 4 with the cover definitively closed and during the printing phase when the shaft moves from the position M to the position E with safety closing.

The schematic view of the different forces which act in the invented safety closing apparatus are shown in FIG. 7.

FIG. 8 is a view of any suitable openable thermal printer 1 with its cover 2 closed/opened.

FIG. 9 is an essential scheme to point out the position of the steel shaft 3*b* on the bottom 4*a* of the housing seat so to disclose a cover closing against accidental pushes and vibrations and to show the cover in its open and closed conditions.

While there has been shown and described, what is considered to be the presently preferred mode for carrying out the present invention, various changes and modifications may be made without departing from the scope of the invention.

What is claimed is:

1. In a thermal printer closing apparatus, for a thermal printer provided with a fixed chassis portion (1), and a cover (2) therefore, the chassis supporting a thermal printer apparatus including a thermal printer head inside the chassis portion and the cover in its closed condition and a paper drive roll having an outside rubber surface (3*a*) and an inside steel shaft having ends (3*b*), said cover and said shaft ends being associated with each other, the rubber surface being molded on said steel shaft, and said shaft ends (3*b*) protruding on the two sides of the rubber surface, and the thermal printer includes a printing phase and a closing phase, and the closing apparatus comprises a housing seat (4) associated with said chassis for the steel shaft, said housing seat having a bottom with a level wall (4*a*) and a concave position;

a method for prevention of damage to the thermal printer, comprising the steps of:

closing the cover at the beginning of the closing phase of the cover (2) and moving the steel shaft ends (3*b*) and the paper drive roll (3) for movement of the steel shaft into the seat (4) and causing the thermal head (6) to rotate on a fulcrum (7) while the cover is closed and with the thermal printer (1) moved into its stand-by condition, and causing the paper drive roll (3) to penetrate into the housing seat (4), and the thermal head (6) rotates on its fulcrum (7) from a position lowering of the roll (3) and being pushed by the springs (8), for pressing the paper (5) between the paper drive roll (3) and the thermal head and moving the shaft ends (3*b*) to the concave portion; and rotating the paper drive roll (3) during the printing phase and as the paper drive roll (3) begins to rotate keeping itself in a printing position E, with the seat (4) and placed into operation by rotation of the paper drive roll (3).

2. The method for prevention of damage to the thermal printer in the thermal printer closing apparatus, as claimed in 1, including:

providing an outside force FE when the printing apparatus is in the printing position E, to act on the paper drive roll (3) by an eventual falling, vibrations or pushes and is opposed, in a first direction of opening/closing of the cover (2), towards a wall of the seat (4) of the roll and, moving the paper drive roll (3) in a direction towards the first direction parallel to the bottom (4*a*) having a level wall of the seat (4), to a force generated by the rotation of the paper drive roll (3) on itself, and keeping the paper (5) compressed between the thermal head (6) and the paper drive roll (3), when this last one is in the printing position E, by the push actuated by the springs (8) on the thermal head (6).

3. In a thermal printer apparatus, having a cover and a chassis, a safety closure for maintaining closure of the cover on the chassis, the printer apparatus being associated with said chassis, a paper drive roll for rotating a printing paper roll carried by a steel shaft and having an outer rubber surface on said steel shaft, said steel shaft having its opposite ends extending outside of and beyond said rubber surface, said printer apparatus being fixed to said chassis, and said cover being movably connected with said chassis for movement from an open position to provide access to said printer apparatus and to a closed position to prevent access to said printer apparatus, said safety closure including:

a housing seat associated with said chassis, said housing seat including a level wall and a concave portion;

said paper drive roll being coupled to said cover, said opposite ends which extend from said rubber surface being movable relative to said housing seat;

locking means for locking said cover to said chassis;

said locking means including an entry to said housing seat for receiving said opposite ends of said steel shaft as said cover moves from the open position to the closed position and holding said ends in said concave portion of said housing seat and locking said cover to said chassis; and a pivotal printing head pivotal on a fulcrum, said pivotal printing head and said housing seat hold paper to be printed thereon as the printing head is moved towards the housing seat by springs associated with said printing head.

4. In the thermal printer as claimed in claim 3, wherein said housing seat includes a U-shaped portion for providing an entry to said housing seat, for receiving said ends of the steel shaft.

5. In the thermal printer as claimed in claim 3, wherein said housing seat includes a U-shaped member having a pair of opposed walls forming an entry and a base joining said opposed walls forming the bottom housing seat.

6. In the thermal printer as claimed in claim 3, wherein said housing seat includes a U-shaped portion having a base portion and a pair of spaced sides for providing an entry to said housing seat, for receiving said ends of the steel shaft.

7. In the thermal printer as claimed in claim 3, wherein said housing seat includes a U-shaped member having a base portion and a pair of spaced opposed walls forming an entry to said base portion joining said opposed walls and forming the bottom housing seat.

8. In the thermal printer as claimed in claim 7, including means for pivoting said printing head towards said housing seat.

9. In a thermal printer apparatus, having a cover and a chassis, a safety closure for maintaining closure of the cover on the chassis, a paper drive roll for carrying printing paper, said paper drive roll including a shaft and an outside rubber surface on said shaft, said paper drive roll being coupled to said safety closure, a printer apparatus including a thermal printing head, said printer apparatus being fixed to said chassis, and said cover being movably connected with said chassis for movement from an open position to provide access to said printer apparatus to a closed position to prevent access to said printer apparatus, said safety closure including:

a housing seat including a level wall associated with said chassis, said housing seat having a concave portion;

means for locking said cover to said chassis, including;

said paper drive roll being coupled to said cover, and said shaft having its opposite ends extending outside of and beyond said rubber surface and being movable relative to said housing seat;

said housing seat including an entry for receiving at least one of said opposite ends of said shaft for movement along said level wall to said concave portion to cooperate therewith for locking said paper drive roll and for locking said cover and said chassis together; and a thermal printing head pivotal on a fulcrum while the cover is closed with the thermal printer moved into its standby condition.

10. In the thermal printer apparatus as claimed in claim 9, wherein said thermal head, said housing seat, said concave portion and said paper drive roll which cooperate to lock said chassis and said cover together also cooperate to hold paper to be printed thereon between said paper drive roll and said thermal print head, and means for urging said thermal print head and said paper drive roll together to hold the paper therebetween.

11. In the thermal printer apparatus as claimed in claim 10, wherein said urging means includes springs for moving said thermal print head into engagement with said paper drive roll as said shaft ends move into locking engagement with said seat for holding the paper in its printing position and locking said cover and chassis together.

12. In the thermal printer as claimed in claim 9, including means for pivoting said thermal printing head towards paper to be printed, said thermal printing head and said housing seat hold paper to be printed thereon as the thermal printing head is moved towards the housing seat by said pivoting means.

13. In the thermal printer as claimed in claim 9, including means for urging said thermal print head and said paper drive roll together for locking said cover and said chassis, said urging mean including springs for urging said thermal print head and said paper drive roll together.

14. In a thermal printer apparatus, a safety closure for maintaining closure of a cover on a chassis, a printing apparatus including a thermal printing head, a paper drive roll coupled to said cover and for carrying printing paper, said paper drive roll including a shaft and an outer rubber surface on said shaft, said printing apparatus being fixed to said chassis, and said cover being movably connected with said chassis for movement from an open position to provide access to said printing apparatus to a closed position to prevent access to said printing apparatus, said safety closure including:

a housing seat associated with said chassis, said housing seat having a concave portion;

means for locking said cover to said chassis, including:

said paper drive roll being coupled to said cover, said shaft having its opposite ends extending outside of and beyond said rubber surface;

said housing seat including an entry to said housing seat for receiving at least one of said opposite ends of said shaft for locking said paper drive roll and said cover and said chassis together;

said housing seat including a horizontal surface having a U-shaped entry portion for receiving the ends of said shaft ends for movement into engagement with said concave portion as a thermal print head moves towards said paper drive roll; and said thermal pivotal printing head pivotal on a fulcrum, means for pivoting said printing head towards paver to be printed, said printing head and said housing seat hold paper to be printed thereon as the printing head is moved toward the housing seat by said pivoting means.

15. In the thermal printer apparatus as claimed in claim 14, wherein said housing seat includes a level wall and said shaft ends move along said level wall.

16. In the thermal printer apparatus as claimed in claim 14, wherein said thermal head, said housing seat, said concave portion and said paper drive roll cooperate to lock said chassis and said cover together and means for urging said thermal print head and said paper drive roll together to hold the paper therebetween.

17. In the thermal printer as claimed in claim 14, wherein said U-shaped entry portion has a base portion and a pair of spaced opposed walls forming an entry to said base portion joining said opposed walls and forming a bottom housing seat.

18. In the thermal printer as claimed in claim 14, wherein said U-shaped entry portion has a base portion and a pair of spaced sides for providing an entry to said housing seat, for receiving said opposite ends of said shaft.

19. In the thermal printer apparatus as claimed in claim 14, including springs for moving said thermal print head into engagement with said paper drive roll as said shaft ends move into locking engagement with said seat for holding the paper in its printing position and locking said cover and chassis together.

* * * * *